United States Patent [19]

Meinecke et al.

[11] Patent Number: 5,019,214

[45] Date of Patent: May 28, 1991

[54] TWIN-WIRE FORMER FOR THE PRODUCTION OF A WEB OF PAPER

[75] Inventors: Albrecht Meinecke; Dieter Egelhof; Wilfried Weiss, all of Heidenheim, Fed. Rep. of Germany

[73] Assignee: J.M. Voith GmbH, Fed. Rep. of Germany

[21] Appl. No.: 451,818

[22] Filed: Dec. 15, 1989

[30] Foreign Application Priority Data

Dec. 15, 1988 [DE] Fed. Rep. of Germany ..... 3842155

[51] Int. Cl.[5] ..... D21F 1/00

[52] U.S. Cl. ..... 162/301; 162/303; 162/308; 162/352; 162/354; 162/363; 162/364

[58] Field of Search ..... 162/300, 301, 303, 308, 162/363, 364, 352, 354

[56] References Cited

U.S. PATENT DOCUMENTS

| | | | |
|---|---|---|---|
| 3,876,499 | 4/1975 | Vesanto | 162/301 X |
| 3,944,464 | 3/1976 | Means | 162/301 X |
| 4,515,542 | 5/1985 | Peschetz | 162/303 X |
| 4,544,447 | 10/1985 | Pinter et al. | 162/300 |
| 4,609,435 | 9/1986 | Tissari | 162/301 X |

FOREIGN PATENT DOCUMENTS 3107730 9/1982 Fed. Rep. of Germany .

*Primary Examiner*—David A. Simmons
*Assistant Examiner*—Thi Dang
*Attorney, Agent, or Firm*—Ostrolenk, Faber, Gerb & Soffen

[57] ABSTRACT

A twin-wire former for the production of a web of paper from a fiber suspension. An upper endless loop of wire belt having a lower horizontal run and a lower endless loop wire belt having an upper horizontal run. Guide rolls support the wire belts to define a twin-wire zone. The upstream inlet wedge of the twin-wire zone is disposed at the outlet from a head box. The initial part of the path of the twin-wire zone has a gradual curvature convexly with respect to the lower wire belt, and in that initial portion are positioned guide tables, suction boxes and dewatering elements. This curved initial part is followed by a forming roll within the loop of the upper wire belt. The twin-wires wrap an arcuate sector of the lower region of the forming roll. A support roll follows the forming roll. The support roll is upraised sufficiently to wrap the twin-wires around the bottom of the forming roll and over an arcuate sector at the top of the support roll. Following the support roll, the upper wire separates from the lower wire. In the continuing generally horizontal, slightly descending path of the lower wire with the web on it are disposed a plurality of suction boxes and a lower wire suction roll to define a final dewatering path after the twin-wire zone.

13 Claims, 2 Drawing Sheets

10
11
12
13
14
15
16
17
18
19
20
21
22
23
24
25
26
27
28
29
30
31
32
33
34
R

TWIN-WIRE FORMER FOR THE PRODUCTION OF A WEB OF PAPER

BACKGROUND OF THE INVENTION

The present invention relates to a twin-wire former for the production of a web of paper, or of a similar fiber web, formed from a suspension of fibers wherein the suspension is fed to the twin-wire former in the form of a machine-wide jet from a head box.

Various embodiments of such twin-wire formers are known, for instance, from German Application OS 31 07 730 or U.S. Pat. No. 4,609,435.

German Application OS 31 07 730 discloses a so-called hybrid twin-wire former, i.e. it has a relatively long single-wire pre-dewatering zone. Following that first zone, a twin-wire zone commences at a forming roll which lies within the loop of the upper wire belt or, simply, upper wire. At the forming roll, the twin-wire zone is curved downwardly, around a relatively small sector of the forming roll. Herein the curving of wire zones "upward" and "downward" is described. An upward curve means that the zone is convex upward, that is toward the upper wire. A downward curve means that the zone is convex downward, that is toward the lower wire. That roll sector lies in the lower ascending quadrant of the forming roll and amounts to about 45° to 60°. A subsequent and adjacent upwardly curved section of the twin-wire zone is formed by a support roll which lies within the loop of the lower wire. The twin-wire zone may end, i.e. the place where the two wires separate from each other, at the support roll or at or after suction boxes which are arranged directly after or downstream of the support roll. The web formed then travels, together with the lower wire, through a "single-wire final dewatering path" which first includes further suction boxes and thereafter includes a wire suction roll for further dewatering of the web. This known twin-wire former is suitable for the production of different types of paper, but only within relatively narrow limits, because it has disadvantages. The thicker is the web of paper to be produced, i.e. the higher the specific basis weight desired, the greater is the required length of the single-wire pre-dewatering zone for a given desired speed of operation to be maintained. Furthermore, the web is formed in the single-wire pre-dewatering zone initially only in a lower layer of the fiber suspension that has been fed. The upper layer of suspension in this case remains initially liquid. As a result, it has a very great tendency to form flakes. Because these flakes can be dissolved only incompletely, if at all, in the following twin-wire zone, the resulting web of paper has a "formation" which is frequently unsatisfactory, i.e. the distribution of fibers in the finished paper web is not uniform. Despite the presence of the twin-wire zone, sometimes there is even a danger that the quality values of the finished web of paper will not be sufficiently uniform on the bottom and top, i.e. the web has a certain two-sidedness.

Another known twin-wire former with similar arrangement of a forming roll and a support roll is described in U.S. Pat. No. 4,609,435. In contrast to the previously described twin-wire former, however, this device is developed as a so-called "nip former" because there is no single-wire pre-dewatering path. Thus, the formation of the fiber web from the suspension of pulp fed from the head box takes place exclusively between the two wire belts. A slightly upwardly curved initial region of the twin-wire zone is present upstream of the forming roll. This known twin-wire former can possibly produce a web with good formation and only slight two-sidedness. But, this is true only for the production of relatively thin paper webs (i.e. on an order of magnitude of 30 to 60 g/m$^2$) with extremely high operating speeds, as indicated in the specification of that U.S. patent.

SUMMARY OF THE INVENTION

It is an object of the present invention to provide a twin-wire former which is able to satisfy the following requirements:

1. It should be possible to produce relatively thick paper webs, on the order of magnitude of 50–200 g/m$^2$, referred to the absolutely dry state. Nevertheless, the paper web formed should leave the twin-wire former with the highest solids content, i.e. the dewatering capacity should be extremely high.

2. The finished paper web should preferably be suitable for packing purposes. Therefore, high quality values, particularly high strength values, should be obtainable.

3. As far as possible, the other quality values of the finished paper web should be the same on both sides, i.e. the top and bottom sides. In particular, the ability of the paper web to absorb adhesives should be the same on both sides. This is important if the paper web is to be used as a corrugated middle layer of corrugated cardboard.

4. The construction of the twin-wire former should be as simple as possible. In particular, the number of expensive suction rolls and the structural height of the entire former should be as small as possible.

5. The twin-wire former should make it possible, if necessary, for the fiber suspension being fed to have a pulp density which is of above average value, on the order of magnitude of preferably 1–2%.

The invention concerns a twin-wire former for the production of a paper web, or the like, from a suspension of fibers. The suspension is fed from a head box to the twin-wire former in the form of a machine-wide stream of pulp suspension. The twin-wire former includes an endless loop lower wire belt, or simply lower wire, which has an upper operative surface or run that extends predominately horizontally. It has an endless loop upper wire belt with a lower run which cooperates with the upper run of the lower wire to form a twin-wire zone.

The twin-wire zone starts at an entrance wedge or nip where the wires are brought together. Following that entrance wedge or nip, means are provided which deflect the twin-wires upwardly (as that term was defined above) along a slightly curved region with a large radius of curvature, preferably in the range of between 5 and 30 meters. This first curved region occupies only a very small arc of a complete circle.

Following the first upwardly curved region, the twin-wires partially wrap around the lower region, particularly the underside, of a forming roll, which lies within the loop of the upper wire, and are conducted in a downwardly convex curve around part of the lower ascending quadrant of the forming roll over an arcuate sector in the range of about 30° to 60°.

Shortly downstream of the forming roll in the path of the twin wires, there is a support roll within the loop of the lower wire. The axis of the support roll is preferably slightly lower than the horizontal plane of the axis of the forming roll and the top of the support roll is above the underside of the forming roll. The twin-wire path extends upward and partially wraps around the top of the support roll in an upward curve.

Following the support roll in the path of the lower wire on which the web travels, there are a plurality of suction boxes. Thereafter, the lower wire with the web on it partially wraps around a suction roll and thereafter, the web is removed from the lower wire.

The upper wire is separated from the web and from the lower wire after the twin-wire zone passes the support roll and preferably before the lower wire with the web on it passes the suction boxes.

Preferably, the two wires are supported by breast or entrance rollers to form the entrance wedge or nip in the initial region of the twin-wire zone and the exit or edge slot from the head box discharges the suspension directly into that entrance wedge.

In the twin-wire former of the invention, it is essential that the twin-wire zone commence as close as possible to the place where the stream of pulp suspension coming from the head box first contacts one of the two wires. This distance is preferably equal to zero. This means that the twin-wire former is a so-called nip former in which the stream of pulp flows directly into the entrance wedge of the wires which are converging toward each other. It is further essential that within the twin-wire zone, the forming roll and the support roll be wrapped around only over relatively small parts of their respective circumferences by the two wires. As a result, none of the rolls within the twin-wire zone need be developed as a suction roll. Only in special cases need one think of developing the support roll as a suction roll. However, one essential further feature of the invention is that there be a final dewatering path after and adjoining the twin-wire zone, in which several suction boxes and a wire suction roll, generally, the only suction roll, cause the web of paper to have a relatively high solids contents already at the place of removal, despite high basis weight.

Because the twin-wire zone preferably commences directly at the point of impingement of the stream of pulp, dewatering takes place in both downward and upward directions from the start. In this way, it is not only possible to produce a very homogeneous web of paper with good formation and only slight two-sidedness but, in addition, one also obtains strength values which are higher than average.

It is further essential that the higher is the specific basis weight of the paper web to be produced, the more care must be taken that the greatest possible dewatering take place not only in the regions of the forming roll and of the support roll, as well as in the final dewatering path, but also in the only slightly upwardly curved, initial curved region of the twin-wire zone. To achieve that, an upwardly curved forming table is arranged within the loop of the lower wire in the initial region and that is followed by a dewatering element, preferably a so-called upper wire deflector, which is arranged within the loop of the upper wire. Another dewatering element may follow in succession.

The twin-wire former of the invention makes it possible, in economical fashion, to produce a relatively thick paper web which has above average technological properties, particularly a high tear strength, and which is thus suitable for further processing for the production of high-quality packing material.

Other objects and features of the invention are described below with reference to the accompanying drawings.

DETAILED DESCRIPTION OF THE PREFERRED EMBODIMENTS

Figure 1:
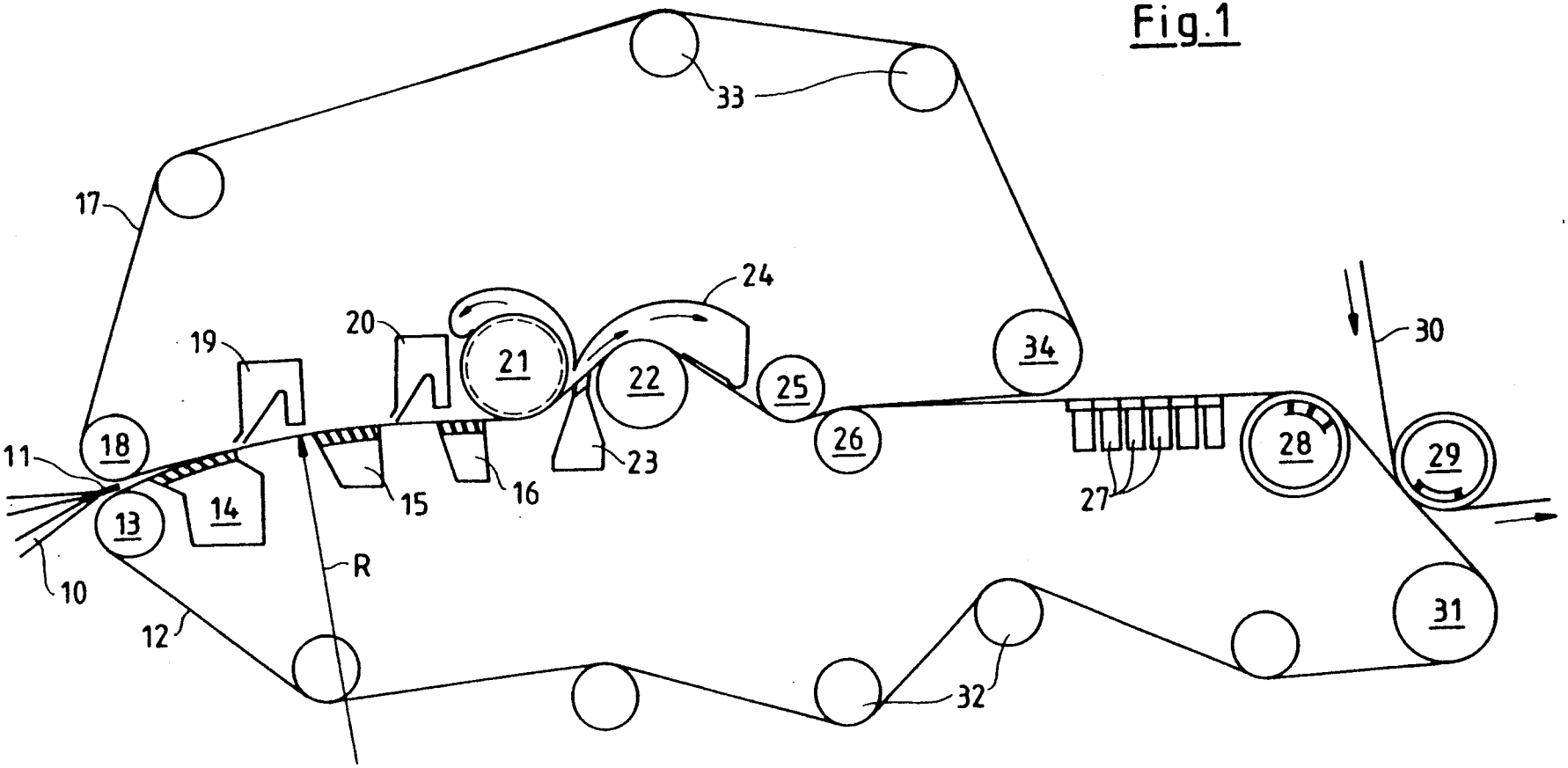
FIGS. 1 and 2 show two embodiments of the invention, both in diagrammatic side view.

At the left in FIG. 1, the outermost part of the outlet nozzle of the head box 10 and the stream of pulp 11 emerging from it can be noted. An endless loop lower wire belt 12 has an upper run that moves generally horizontally. It first travels over a lower breast roll 13, followed by a lower forming table 14 and suction boxes 15 and 16. The forming table 14 inside the loop of the wire belt 12 has an upwardly curved upper travel surface. In the region of the table 14, the lower wire converges with a similarly endless loop upper wire belt 17, which has a lower run that cooperates with the upper run of the lower wire. The upper wire is guided there over an upper breast roll 18. The twin-wire zone thus commences on the forming table 14. The stream of pulp 11 passes directly into the inlet wedge formed by the two wires 12 and 17. The forming table 14 and the suction boxes 15 and 16 are arranged to that the two wires 12 and 17 first travel over an initially only slightly upwardly curving, path or region with a large radius of curvature R =5...30 m). Dewatering elements 19 and 20 are also arranged in the region of the table 14 and the suction boxes 15 and 16 within the loop of the upper wire 17. For instance, elements 19 and 20 are so-called upper-wire deflectors.

Directly after the second suction box 16, a forming roll 21 is arranged within the loop of the upper wire. As shown in dashed-line, its surface has recesses for the temporary storage of water, for instance, circumferential grooves, blind holes, fabric blanket or honeycomb covering. The wires, arrive approximately horizontally at the forming roll, and are conducted slightly upward in a downwardly convex curve around an arc of only about 30° to 60° by the forming roll 21.

Following the forming roll 21, there is a support roll 22, which is arranged within the loop of the lower wire. The axis of the support roll is below the axis of the forming roll 21 with respect to the horizontal. Further, the top of the support roll 22 is above the underside of the forming roll. The roll 21 is preferably developed as a simple smooth roll. A support element 23 having an upwardly curved travel surface can be present within the loop of the lower wire between the rolls 21 and 22. Following the support roll 21, the path of the two wires curves upwardly. This permits a water collection device 24, developed in accordance with European patent 73223, which is equivalent to U.S. Pat. No. 4,908,102 to be arranged above the support roll 22.

The place at which the upper wire 17 separates from the lower wire 12 and from the web of paper formed can, for instance, be developed in the form of two guide rolls 25 and 26 in the loops of the upper and lower wires, respectively. The lower wire 12 then travels together with the web of paper over several flat suction boxes 27 and over a wire suction roll 28. Following the suction roll 28, the web of paper is lifted off the lower wire 12 by means of a pick-up suction roll 29 and by a pick-up felt belt 30. The lower wire travels back to the entrance nip over a wire drive roll 31 and a plurality of guide rolls 32. The upper wire travels back to the entrance nip over a plurality of guide rolls 33 and a drive roll 34.

Figure 2:
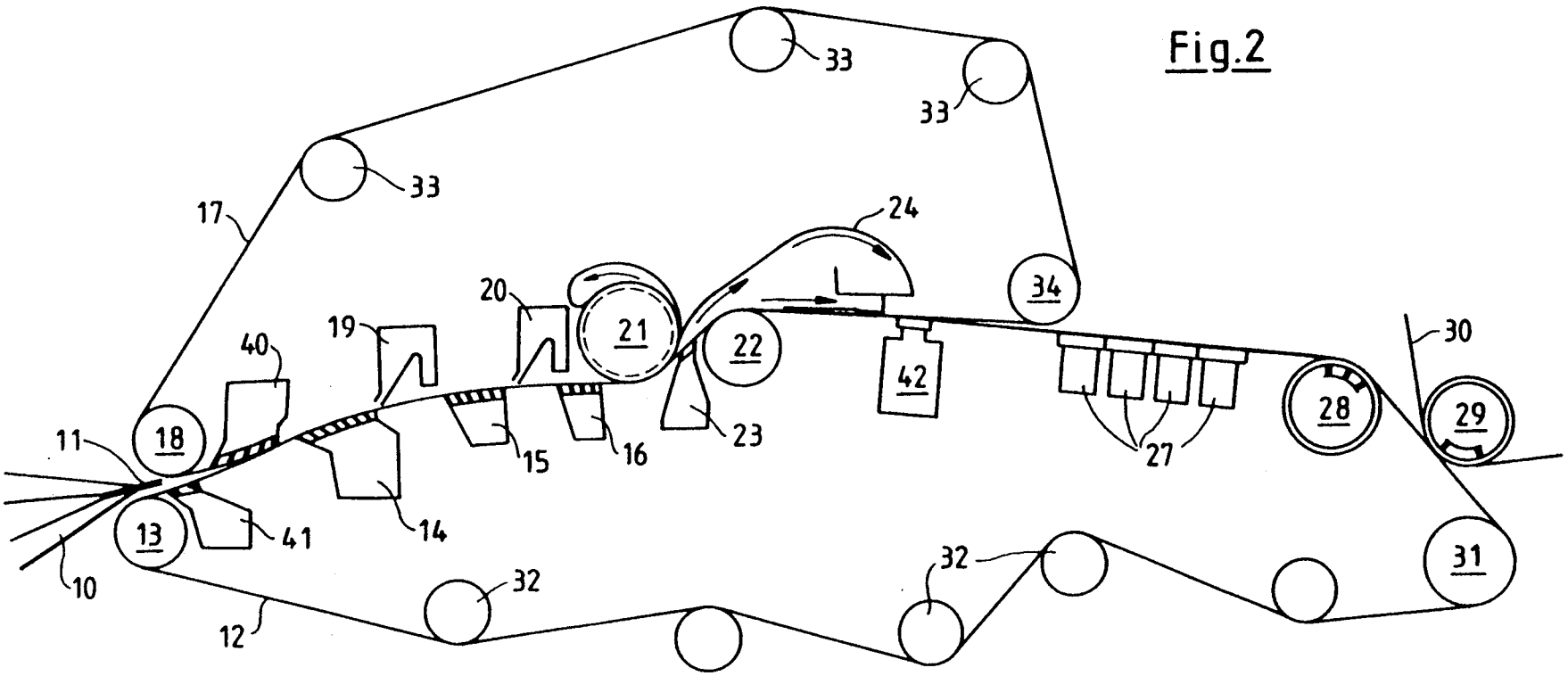

In the embodiment shown in FIG. 2, many elements having the same reference numbers as in FIG. 1 are essentially unchanged. As a new feature, within the region of the entrance wedge, there is an additional forming table or suction box 40 having downwardly curved travel surface arranged within the loop of the upper wire directly following the upper breast roll 18. Generally opposite the forming table or suction box 40, an additional supporting ledge 41, or the like, can be arranged within the loop of the lower wire, directly following lower breast roll 13. As shown in FIG. 2, the ledge 41 is preferably somewhat displaced upstream with respect to the forming table 40, i.e., at a smaller distance from the head box 10. The travel path of the two wires 12 and 17 is thus initially curved very slightly downward at box 40 before the slightly upwardly curved path begins at table 14.

FIG. 2 also shows another modification from the embodiment in FIG. 1. The travel path of the lower wire 12 moves from the support roll 22 to the wire suction roll 28 along a path that is substantially linear and is inclined slightly downward. The place of separation of the upper wire 17 from the lower wire 12 is, in this case, located at a so-called separation suction box 42.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A twin-wire former for producing a relatively thick web from a fiber suspension which is relatively dry upon reaching the downstream end of said twin-wire former, wherein the fiber suspension is fed through the exit of a head in the form of a machine-wide stream, the twin-wire former comprising:

a lower wire belt in the form of an endless loop having an upper run which predominantly extends generally horiztonally;

an upper wire belt in the form of an endless loop having a lower run which generally overlies and cooperates with the upper run of the lower wire belt, with respective portions of their generally horizontal upper and lower runs forming a twin-wire zone;

means supporting the upper and lower wire belts for defining a path of the twin-wire zone which comprises:

an entrance wedge adjacent to said head box exit at which the lower run of the upper wire belt and the upper run of the lower wire belt are first brought together;

wherein the means supporting the upper and lower wire belts form the entrance wedge in the initial region of the twin-wire zone and the entrance wedge is positioned at the exit slot of the head box which discharges directly into the entrance wedge;

downstream of the entrance wedge, a slightly upwardly curved initial portion of the path having a relatively large radius of curvature in the range of 5 to 30 m;

wherein the initial portion of the path in the twin-wire zone includes in it a plurality of twin-wire supporting elements in the following sequence downstream of the entrance wedge;

a forming table having a curved travel surface over which the lower wire belt passes and disposed within the loop of the lower wire belt, a dewatering element arranged within the loop of the upper wire belt above the lower run of the upper wire belt and positioned for removing water which may in part be caused to leave the wire belts as a result of having passed the preceding curved travel surface, and an initial suction box having a curved travel surface within the loop of the lower wire belt;

a second dewatering element arranged within the loop of the upper wire belt downstream from the initial suction box for in part removing the water caused to exit from the lower run of the upper wire belt by the curved travel surface of the initial suction box, and a further suction box within the loop of the lower wire belt and downstream of the second dewatering element;

downstream of the initial portion of the path, a non-suction forming roll within the loop of the upper wire, and the twin-wires passing in a downwardly convex curve over a relatively small arcuate sector of about 30° to 60° of the forming roll, at the lower region and up the lower ascending quadrant of the forming roll;

downstream of the support roll, means separating the upper wire belt from the lower wire belt;

further downstream in the path of the lower wire belt, suction means for suctioning the lower wire belt and for defining the final dewatering path of the lower wire belt after the twin-wire zone, wherein the suction means operating on the lower wire belt comprises a plurality of suction boxes adjacent to the lower wire belt and further comprises a wire suction roll disposed downstream in the path of the lower wire belt from the suction boxes, and the lower wire belt partially wrapping the suction roll, after which the web has a relatively high solids content, despite also having high basis weight.

2. The twin-wire former of claim 1, further comprising an additional support element having a curved travel surface disposed within the loop of the lower wire belt and arranged between the forming roll and the support roll for engaging the lower wire belt therewith.

3. The twin-wire former of claim 2, further comprising an additional forming table having a downwardly convex curved travel surface disposed within the loop of the upper wire belt in the initial portion of the path and shortly downstream of the entrance wedge but upstream of said forming table having a curved travel surface, the travel surface of the additional forming table engaging the lower run of the upper wire.

4. The twin-wire former of claim 3, wherein the support means for the lower wire belt directs the upper run of the lower wire belt in a substantially linear path from the support roll past the suction boxes to said wire suction roll along a gradually descending pathway, said wire suction roll being at a downstream end of said gradually descending pathway.

5. The twin-wire former of claim 3, wherein said additional forming table includes suction means for removing water from said web.

6. The twin-wire former of claim 2, wherein the support means for the lower wire belt directs the upper run of the lower wire belt in a substantially linear path from the support roll past the suction boxes to said wire suction roll along a gradually descending pathway, said wire suction roll being at a downstream end of said gradually descending pathway.

7. The twin-wire former of claim 1, further comprising an additional forming table having a downwardly convex curved travel surface disposed within the loop of the upper wire belt in the initial portion of the path and shortly downstream of the entrance wedge upstream of said forming table having a curved travel surface but the travel surface of the additional forming table engaging the lower run of the upper wire.

8. The twin-wire former of claim 1, wherein the support means for the lower wire belt directs the upper run of the lower wire belt in a substantially linear path from the support roll past the suction boxes to said wire suction roll along a gradually descending pathway, said wire suction roll being at a downstream end of said gradually descending pathway.

9. The twin-wire former of claim 7, wherein said additional forming table includes suction means for removing water from said web.

10. The twin-wire former of claim 1, wherein the top of the support roll is above the underside of the forming roll.

11. The twin-wire former of claim 10, wherein the axis of the support roll is lower than the axis of the forming roll.

12. The twin-wire former of claim 1, wherein the support means for the lower wire belt directs the upper run of the lower wire belt in a substantially linear path from the support roll past the suction boxes to said wire suction roll along a gradually descending pathway, said wire suction roll being at a downstream end of said gradually descending pathway.

13. The twin-wire former of claim 1, wherein said wire suction roll is the only suction roll in the twin-wire former.

* * * * *